United States Patent [19]

Kunreuther et al.

[11] Patent Number: 4,589,583

[45] Date of Patent: May 20, 1986

[54] AUTOMATIC HOOK ATTACHING APPARATUS

[75] Inventors: Steven J. Kunreuther, New York, N.Y.; John T. Roberts, Clover, S.C.

[73] Assignee: Kunreuther and Beringhause, Carle Place, N.Y.

[21] Appl. No.: 642,403

[22] Filed: Aug. 20, 1984

[51] Int. Cl.[4] ..... B27F 7/02

[52] U.S. Cl. ..... 227/43; 227/99; 227/114; 227/116; 493/372

[58] Field of Search ..... 227/43, 67, 114, 115, 227/116, 99, 136; 493/372; 221/187, 209, 268, 273, 312 R

[56] References Cited

U.S. PATENT DOCUMENTS

| | | | |
|---|---|---|---|
| 847,828 | 3/1907 | Sandleben | 221/273 |
| 1,407,295 | 2/1922 | Parker . | |
| 2,978,705 | 4/1961 | Moberg | 227/114 |
| 3,025,054 | 3/1962 | Clemens et al. | 227/136 X |
| 3,103,666 | 9/1963 | Bone | 227/67 |
| 3,265,274 | 8/1966 | Burnell | 227/7 |
| 3,564,983 | 2/1971 | Grimm | 227/67 |
| 3,598,025 | 8/1971 | Cotton | 227/67 |
| 3,896,713 | 7/1975 | Mato | 227/67 |
| 3,985,067 | 10/1976 | Livio et al. | 227/67 |
| 4,023,722 | 5/1977 | Grushon | 227/136 X |
| 4,235,161 | 11/1980 | Kunreuther | 493/376 |
| 4,237,779 | 12/1980 | Kunreuther | 493/372 |

OTHER PUBLICATIONS

Texpak References, Descriptions of Four Models.

*Primary Examiner*—Robert L. Spruill
*Assistant Examiner*—Taylor J. Ross
*Attorney, Agent, or Firm*—James & Franklin

[57] ABSTRACT

A conventional fastener attacher is fixedly mounted on a support. A stack of hooks is situated in a retainer which is movably mounted with respect to the support. A dispensing slide is movably mounted on the retainer, below the stack. As the retainer is moved towards the attacher, the slide automatically moves relative to the retainer to align a hook with the attacher. Slide movement is achieved through the use of a cam surface on the support and a cam follower extending from the slide. A single air cylinder moves both the retainer and the slide. The retainer can hold the stack in one of two orientations. In order to avoid jamming, the hook is held on the slide as it retracts or is realigned with the stack, if the hook has not been removed from the apparatus.

19 Claims, 17 Drawing Figures

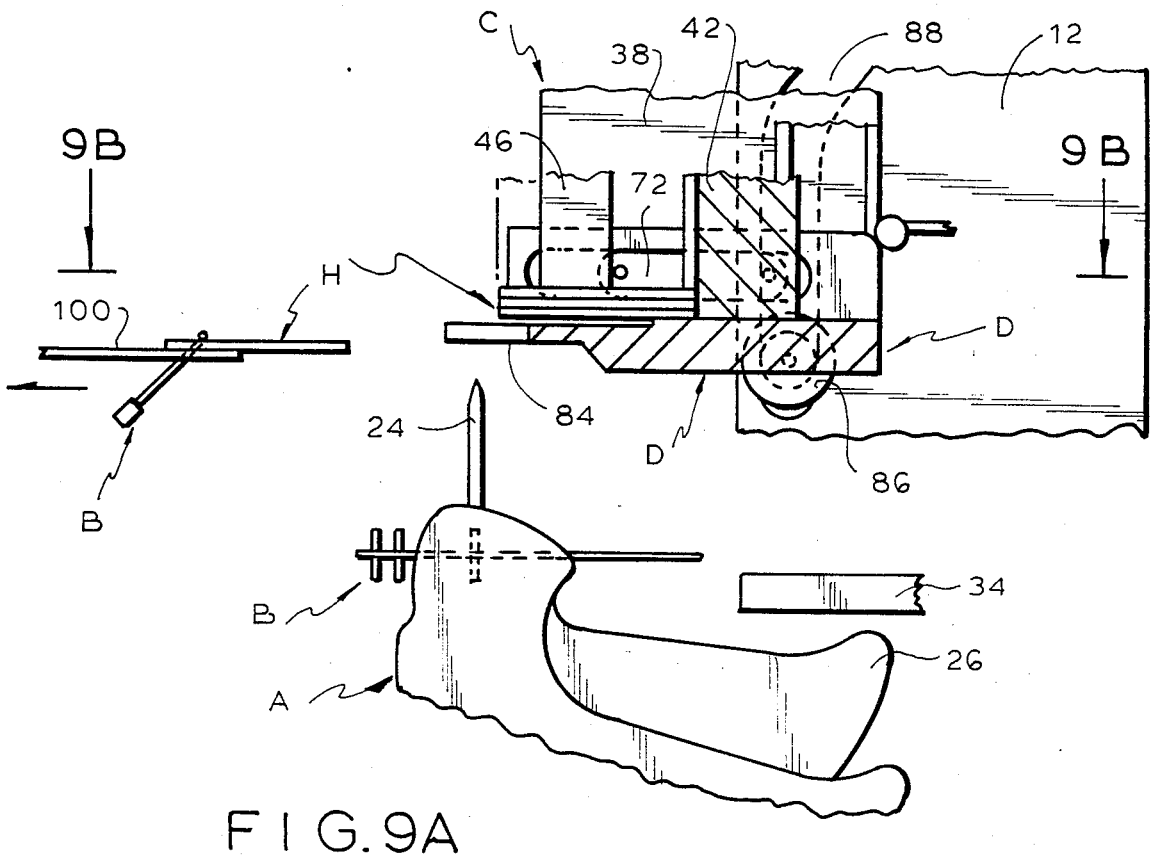
FIG. 9A
FIG. 9B
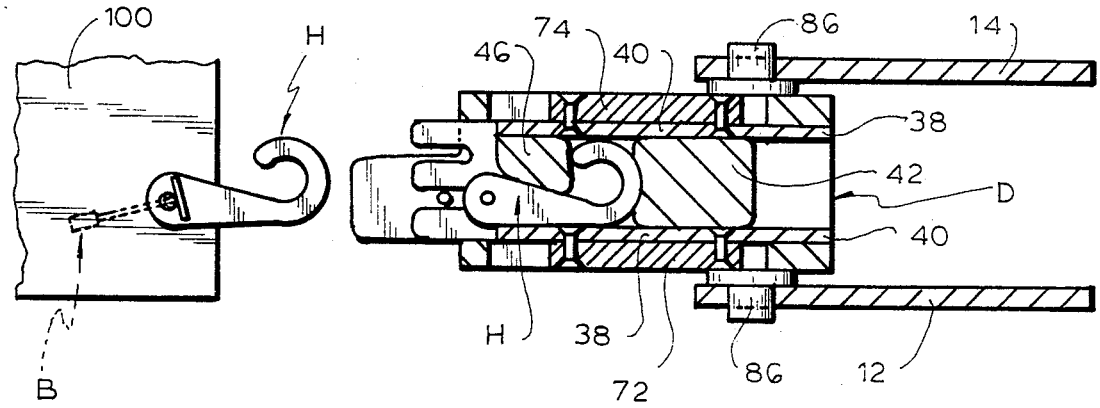

FIG. 10
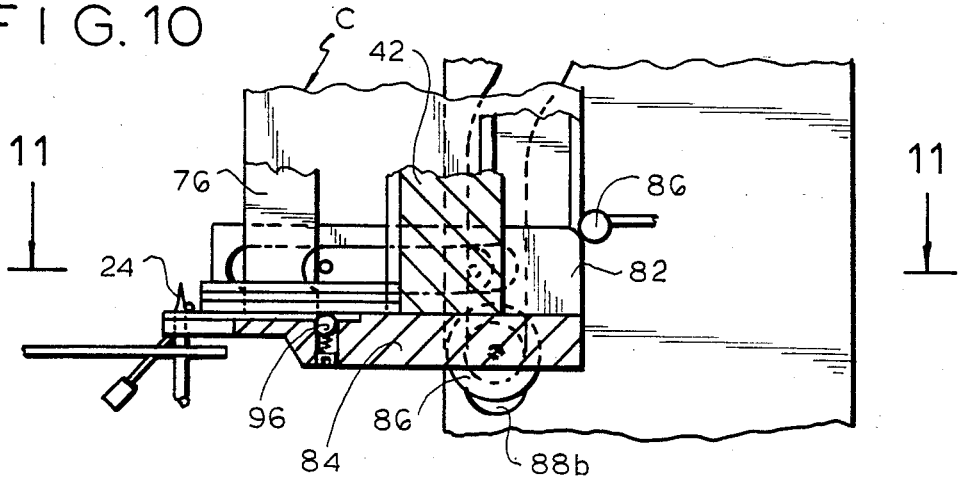
FIG. 11
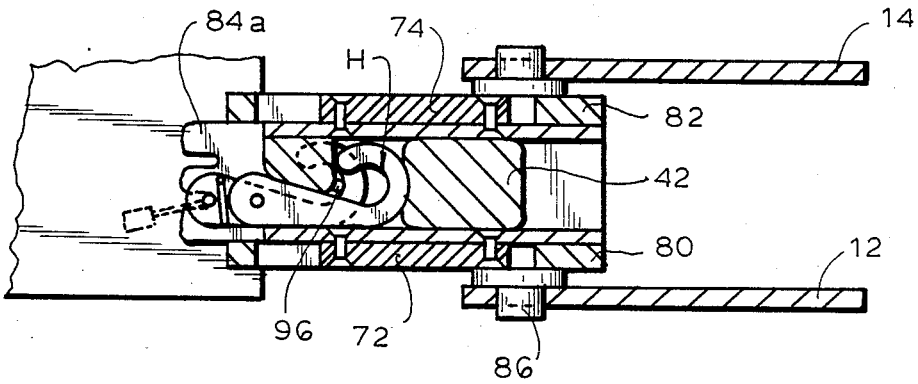
FIG. 13
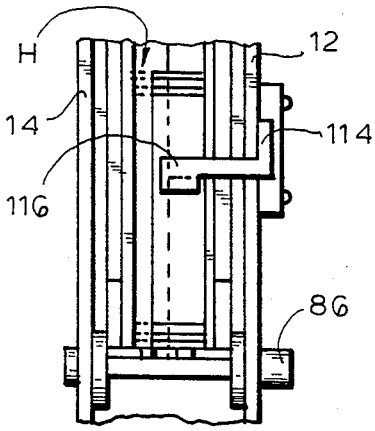
FIG. 12
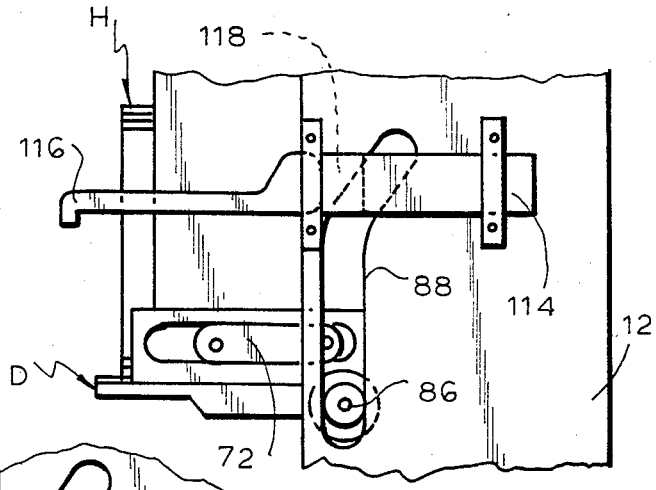
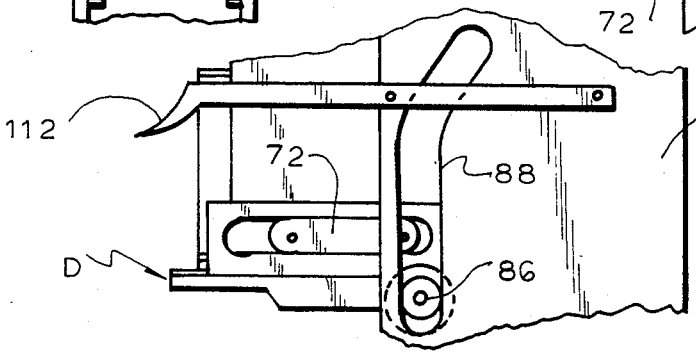
FIG. 14

AUTOMATIC HOOK ATTACHING APPARATUS

The present invention relates to automatic hook attaching apparatus and, more particularly, to an improved hook attaching apparatus of simplified design which is versatile enough to permit feeding hooks in different orientations and which includes a mechanism to prevent jamming.

Various industries require that hooks be attached to merchandise prior to sale. For instance, in the retail wearing apparel industry, millions of garments are routinely provided with hooks to permit same to be hung on display racks in retail establishments. In particular, socks and the like are often provided with plastic hooks for hanging on display bars. Because of the great quantity of articles which must be processed in this fashion, it is necessary that the attaching operation be performed as inexpensively as possible. Further, the hooks must be affixed to the article in a secure manner so that they cannot become detached and fall off the display.

The most widely used attaching system includes a hand-held attacher or gun in which a clip of plastic attachments or fasteners is mounted. Each of the fasteners includes a T-bar and an enlarged paddle connected by a relatively thin plastic filament. Actuation of the attacher causes the T-bar portion of the fastener to be pushed through a hollow needle. Thus, when the needle is inserted through an opening in the article and through a hole in the hook, and the attacher is actuated, the T-bar end of the fastener will move through the needle and, thereafter, be situated on one side of the garment, with the paddle end being situated on the other.

This system results in a relatively low-cost attaching operation because a minimum of unskilled labor is required and the cost of the plastic fasteners and the gun-type attacher is relatively small. Further, the attaching operation is accomplished within a few seconds. Security is assured with this type of fastener because the fastener is made of strong plastic which prevents the hook from being removed, except by the destruction of the article or hook or by cutting the filament of the fastener.

Fasteners and attachers of this type are commercially available from Dennison Manufacturing Company of Framingham, Mass., and other suppliers, and are widely used throughout this country and in many other countries of the world. The attachers are basically of gun shape and may either be of the pistol-grip type or the scissor-grip type. Needles for the fasteners come in a variety of different sizes for use with articles of different characteristics, from fine lingerie to leather shoes.

The attachers are primarily designed for hand-held manual use and a great majority of the attachers utilized today are used in this manner. However, the very large number of attaching operations which take place on a daily basis indicate the desirability for automating the attaching operation.

Known automated tagging apparatus utilizing conventional fastener attachers require that the needle of the attacher pierce the article and be inserted through the hole in the hook prior to the actuation of the attacher. The operator of the apparatus must hold the article to be tagged and the hook together when the needle is advanced to pierce the article. There is, therefore, a great danger of injury to the hands of the operator from the sharp point of the needle. This is particularly the case when it is necessary that the hole in the hook be accurately aligned with the needle, prior to the piercing of the article by the needle.

U.S. Pat. No. 4,237,779, issued Dec. 9, 1980 to Steven J. Kunreuther, and entitled "Automatic Attaching Apparatus," relates to automatic apparatus which has solved this problem to a large extent. However, it has been found that this apparatus can be improved in certain ways.

The apparatus described in U.S. Pat. No. 4,237,779 is designed for automatic attachment of a header, a tag, or the like to a softgoods article by means of a plastic fastener. A commercial fastener attacher of the non-automatic hand-held variety is fixedly mounted on a support. The attacher has a stationary hollow needle through which the fastener is dispensed.

Above the attacher is located a platform which is spring loaded to a support and has an opening aligned with the axis of the needle. Spaced from the platform is a clamping member having a recess aligned with the axis of the needle. The operator inserts the header or tag and the article between the member and the platform and actuates the apparatus. The member moves towards the platform to clamp the header or the tag and the article in face-to-face relationship therebetween. Further movement of the member causes the clamped header or tag and article assembly to move relative to the attacher to position same on the needle. The attacher actuating mechanism, responsive to the movement of the platform, causes the attacher to dispense a fastener when the article is properly positioned.

The above-described apparatus could be used for attaching hooks to articles in the same manner. However, the use of this type of apparatus does not completely automate such an attaching operation because there is no provision for automatically feeding hooks, one at a time, into position with respect to the needle.

In order to more fully automate the attaching operation, a new machine was devised. That machine is the subject of U.S. Pat. No. 4,235,161, issued Nov. 25, 1980 to Steven J. Kunreuther and entitled "Automatic Tag Attaching Apparatus." The machine described in U.S. Pat. No. 4,235,161 uses a conventional fastener attacher which is vertically mounted to a support in a fixed position in a manner which permits pneumatic actuation thereof. A carriage, which is movable along an upstanding guide mounted on the support, has mounted thereon a pneumatically actuated tag feed mechanism.

When actuated, the feed mechanism moves a tag from a position out of alignment with the axis of the needle of the attacher to a position in alignment with the axis of the needle. Thereafter, the carriage is moved towards the attacher, in a direction substantially parallel to the axis of the needle, to place the fed tag on the needle. In one embodiment, a second carriage, movable along a second upstanding guide, carries a hook-feed mechanism which, when actuated, moves a hook to the position spaced from, but in alignment with, the needle. The article to which the tag and hook are to be attached is held between the needle and the hook. The second carriage is actuated to place the hook and, thus, the article on the needle. The attacher is then actuated to dispense a fastener to attach the tag and the hook to the article.

Through use of the machine described in U.S. Pat. No. 4,235,161, it has been determined that while the hook feed mechanism functions satisfactorily, it is overly complex and, in particular, requires two separately actuatable pneumatic cylinders in order to perform its function. Moreover, the structure of the hook feed mechanism utilized in that machine is not versatile enough to operate on hooks which are oriented in different orientations, although it is sometimes necessary for the hooks to be attached to the articles in either of two orientations. Moreover, the hook feed mechanism tends to jam in the event that a fastener is not properly dispensed from the attacher, either because of a problem with the gun or because all of the fasteners in the clip in the gun have been used. This may cause significant down time.

It is, therefore, a prime object of the present invention to provide an automatic hook attaching apparatus which employs a greatly simplified hook dispensing mechanism.

It is another object of the present invention to provide an automatic hook attaching apparatus in which hooks are moved into alignment with the needle and, thereafter, over the needle, through the use of a single pneumatic cylinder.

It is another object of the present invention to provide an automatic hook attaching apparatus which is versatile enough to dispense hooks in one of two orientations.

It is another object of the present invention to provide an automatic hook attaching apparatus which employs a mechanism which prevents jamming in the event that a plastic fastener is not properly dispensed.

It is another object of the present invention to provide an automatic hook attaching apparatus which includes an anti-jamming mechanism in the form of means which holds the hook on the slide, as it retracts, if the hook has not been removed from the slide.

It is another object of the present invention to provide automatic hook attaching apparatus formed of relatively simple parts which cooperate together reliably for a long, useful life.

In accordance with the present invention, apparatus is provided for attaching a hook or the like to an article, the hook being of the type having an aperture therein. The apparatus comprises a base, means on the base for fixedly mounting a fastener attacher of the type having a hollow needle through which fasteners are dispensed in response to the actuation of the attacher. Means are provided for actuating the attacher. Means are provided for retaining a stack of hooks. Means are mounted on the retaining means for dispensing hooks, one at a time, from the retaining means. Means are provided for mounting the retaining means and the dispensing means for movement as a unit in a first direction relative to the needle. The mounting means comprises means for automatically moving the dispensing means relative to the retaining means, in response to the movement of the retaining means in the first direction. The dispensing means moves in a second direction relative to the needle to align a hook therewith. Means are provided for moving the retaining means in the first direction.

The mounting means comprises a member fixedly mounted to the base and having a cam surface. The dispensing means comprises a cam follower in operative engagement with the cam surface. The cam surface includes a first portion and a second portion. The first portion extends in a third direction and the second portion extends in the first direction. The third direction is between the first and second directions.

The member comprises means for guiding the movement of the retaining means in the first direction. Means for guiding the movement of the dispensing means relative to the retaining means in the second direction are also provided.

The dispensing means comprises a slide movably mounted on the retaining means adjacent one end of the stack. The slide comprises a surface normally aligned with the stack and abutting means normally engaged in the trailing edge of the first hook in the stack. The abutting means has a height which is less than the thickness of the hook.

The surface of the slide has a portion aligned with the leading portion of the first hook. This surface portion has an opening therein aligned with the aperture in the first hook.

The hooks can be retained in the retaining means in one of two orientations. The slide surface has first and second openings therein. Each of the openings aligns with the aperture in the first hook when the first hook is in a different one of the orientations.

The retaining means comprises means for holding the stack on the retaining means in one of two different orientations. The retaining means comprises first and second spaced substantially parallel walls between which the stack is situated. Holding means are provided comprising a member adapted to be situated in one of two orientations relative to the walls to hold the stack adjacent one of the walls.

The hooks in the stack each comprise an edge adapted to be situated substantially parallel to one of the walls and an edge adapted to be situated in inclination with respect thereto. The holding member comprises a surface adapted to be situated substantially parallel to the other of the walls and an inclined surface adapted to be situated adjacent the edge of the hooks adapted to be situated at an incline with respect to the one wall.

The hooks and the holding member can be re-oriented within the retaining means such that the edges of the hooks adapted to be situated parallel to one wall are situated parallel to the other wall and the surface of the holding member adapted to be situated parallel to the other wall is situated parallel to the first wall.

The dispensing means comprises a slide movable in the second direction to align a hook with the needle and retract. The apparatus further comprises means for holding the hook to the slide as the slide retracts, if the hook has not been removed therefrom. The holding means comprises a spring loaded member associated with the slide and adapted to engage the hook on the slide to prevent relative movement between the slide and the hook.

In another embodiment, the means are provided for realigning a dispensed hook with the remainder of the stack, if it has not been removed from the slide. This means includes either a stationary member with an inclined surface or a movable member which retracts as the retaining means moves upwardly toward its start position.

To these and to such other objects which may hereinafter appear, the present invention relates to automatic hook attaching apparatus as described in the following specification and recited in the annexed claims, taken together with the accompanying drawings, wherein like numerals refer to like parts, and in which:

FIGS. 7A, 7B and 8A, 8B, and 9A, 9B, respectively, are side and top sequential views of the apparatus of the present invention in different stages of its operation;

FIG. 10 is a side view of a section of the apparatus of the present invention illustrating the hook holding means;

FIG. 11 is a top view taken along line 11—11 of FIG. 10;

FIG. 12 is a fragmentary side view showing a first embodiment of the hook realignment means;

FIG. 13 is a fragmentary front view showing the first preferred embodiment of the hook realignment means; and FIG. 14 is a side fragmentary view of a second embodiment of the hook realignment means.

Figure 1:
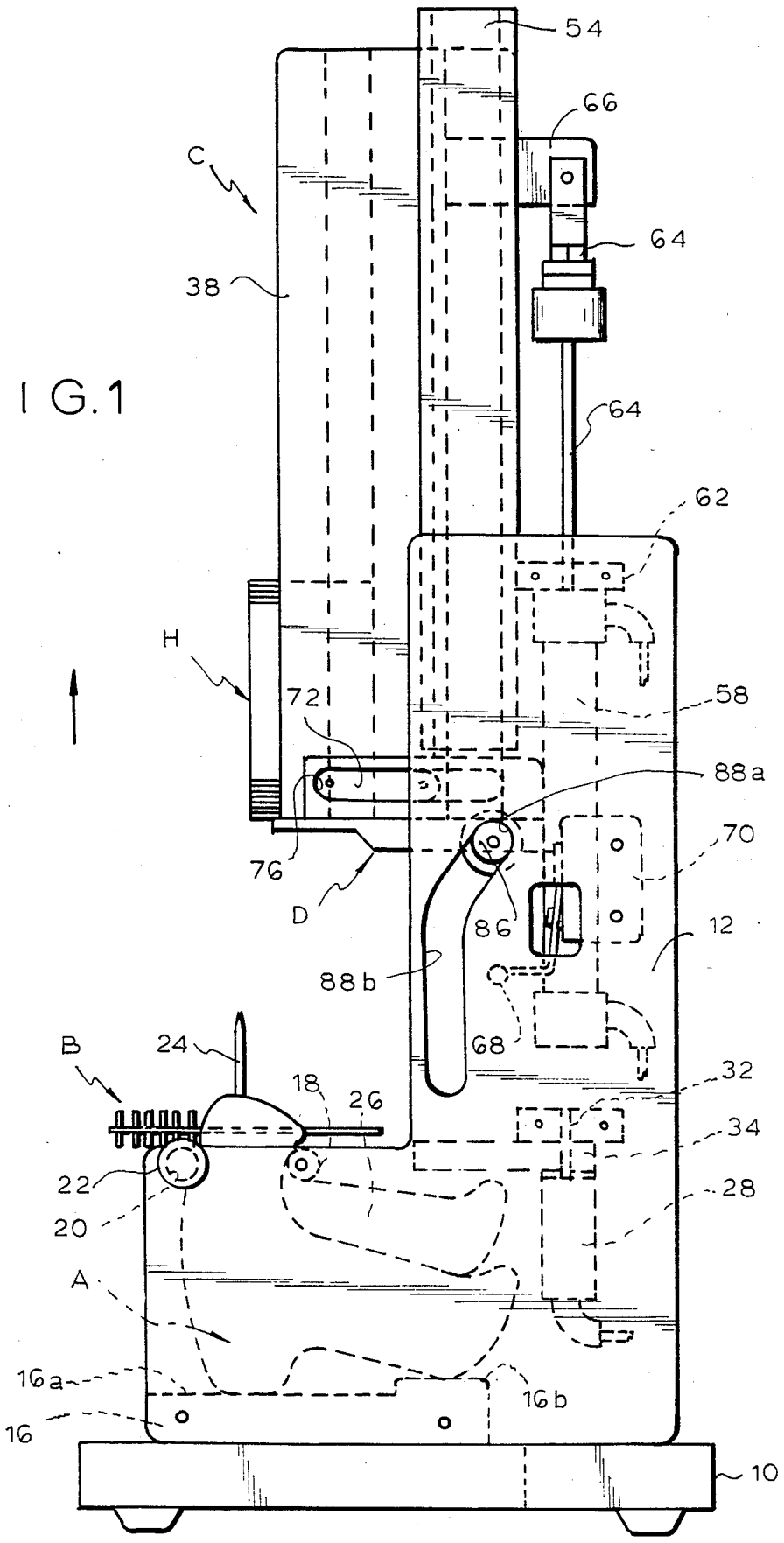
FIG. 1 is a side view of the automatic hook attaching apparatus of the present invention showing the retaining means in its rest positions.
Figure 2:
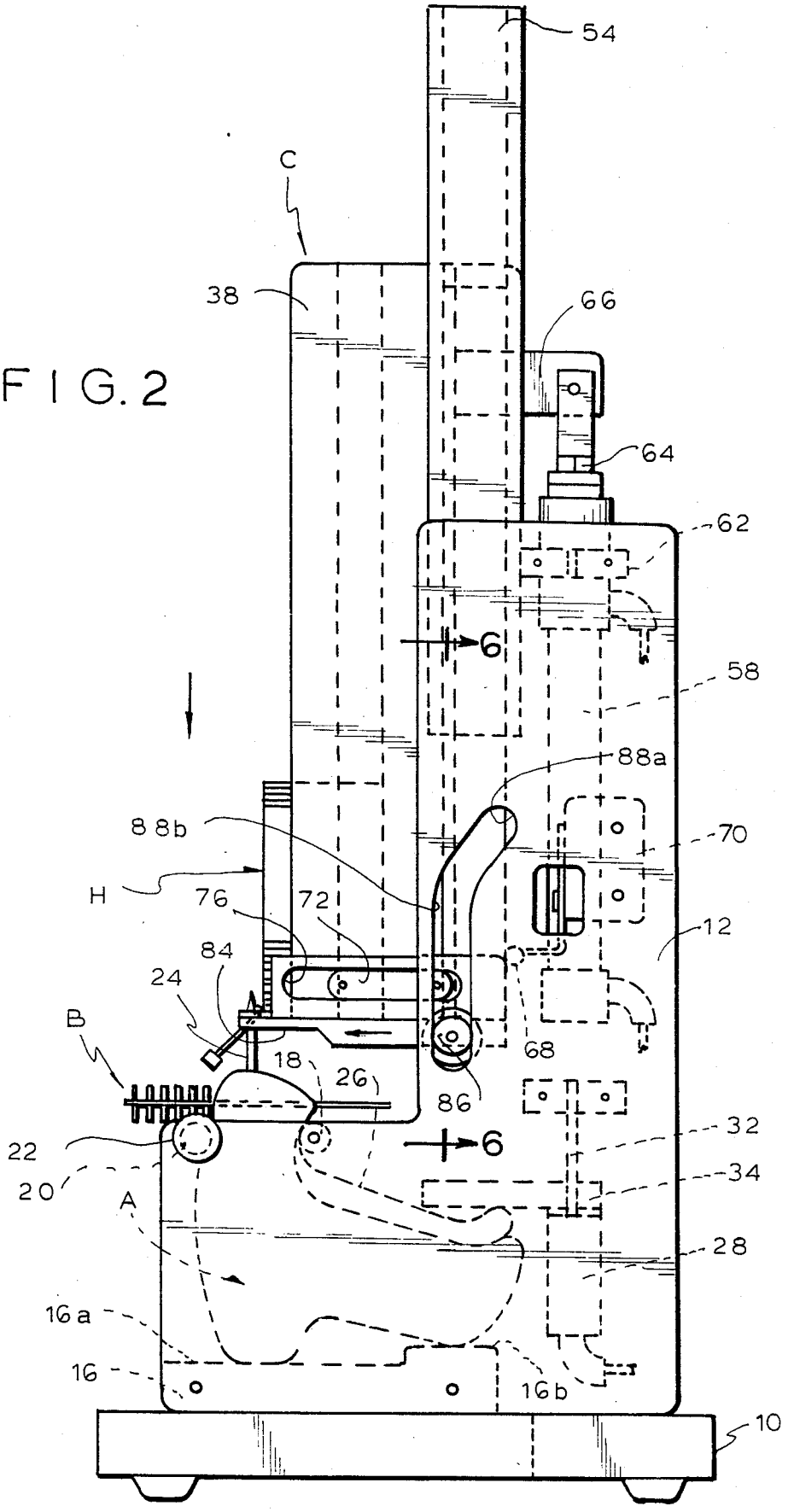
FIG. 2 is a view similar to FIG. 1, but showing the retaining means in its dispensing position.
Figure 3:
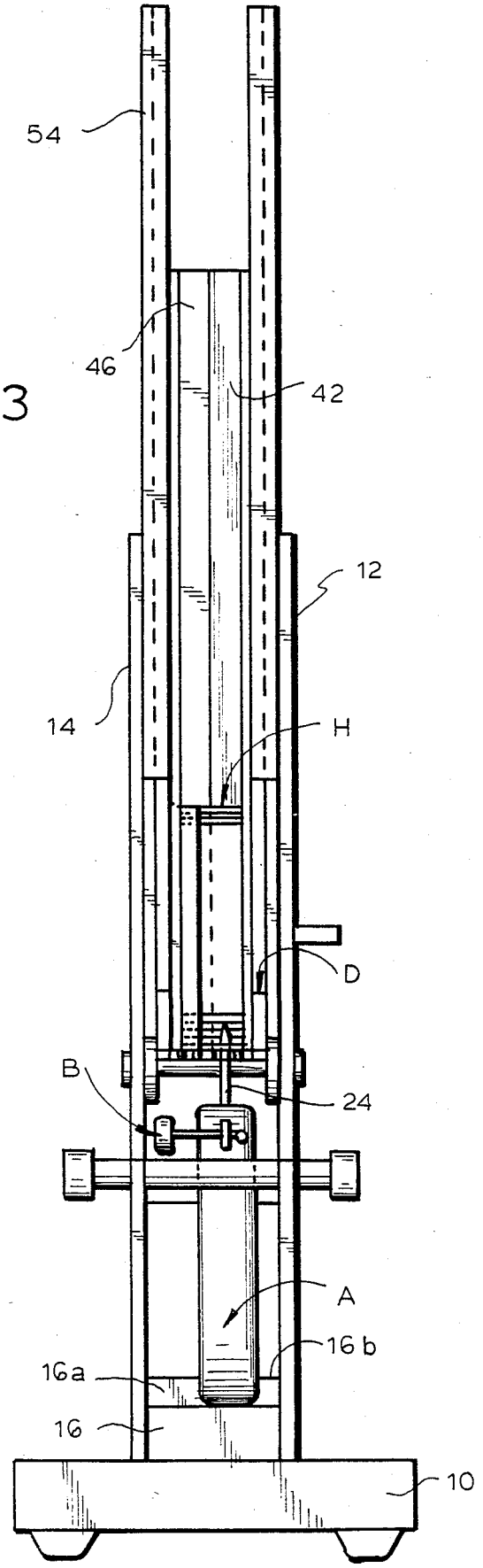
FIG. 3 is a front view of the present invention.

As best seen in FIGS. 1, 2, and 3, the apparatus of the present invention includes a base 10 designed to be placed on the top of a work table or the like. Extending upwardly from base 10 are a pair of spaced, substantially parallel planar "L"-shaped support members 12, 14 between which the components of the apparatus are mounted. Adjacent to the surface of base 10, extending between support members 12 and 14, is a stepped platform 16 upon which a conventional fastener attacher, generally designated A, is mounted.

The upper surface of support 16 includes a lower portion 16*a* and an upper portion 16*b*. The rear of the body of attacher A rests on surface 16*a*, whereas the rear of the handle portion of attacher A rests on the step portion 16*b*. Of course, for attachers of different shape, a support of different configuration may be required.

The top of the body of attacher A is secured between support members 12 and 14 by a pair of shafts 18, 20. Shaft 18 is permanently affixed between support members 12 and 14 and shaft 20, which extends outwardly beyond the support members, is removably mounted to the support members to permit attacher A to be installed in the apparatus. Shaft 20 is provided with removable end members 22 on either end thereof to permit shaft 20 to be removed from between the support members for mounting of the attacher.

As seen in the drawings, the forward end of the body portion of attacher A extends above the top edge of the forward or "foot" portions of support members 12 and 14 such that it is accessible from above. This permits the operator to load a clip of fasteners, generally designated B, into attacher A. Attacher A has a hollow needle 24 through which fasteners B are dispensed, one at a time, upon the actuation of attacher A. Needle 24 is retained in a substantially vertical position. Attacher A is actuated by depressing trigger member 26, as shown in FIGS. 1 and 2.

A pneumatic cylinder 28 is situated between support members 12 and 14 directly behind attacher A. A bracket 30 extends from support member 12 and is fixedly mounted thereto. Piston rod 32 of cylinder 28 is fixedly attached to bracket 30 such that when cylinder 28 is actuated, it will move downwardly, away from bracket 30. Fixedly mounted to the top of cylinder 28 is an actuation member 34 which extends to a position in alignment with trigger 26 of attacher A. When cylinder 28 is actuated and moves downwardly, away from bracket 30, actuation member 34 moves with it so as to depress trigger 26, resulting in the actuation of attacher A.

Figure 5:
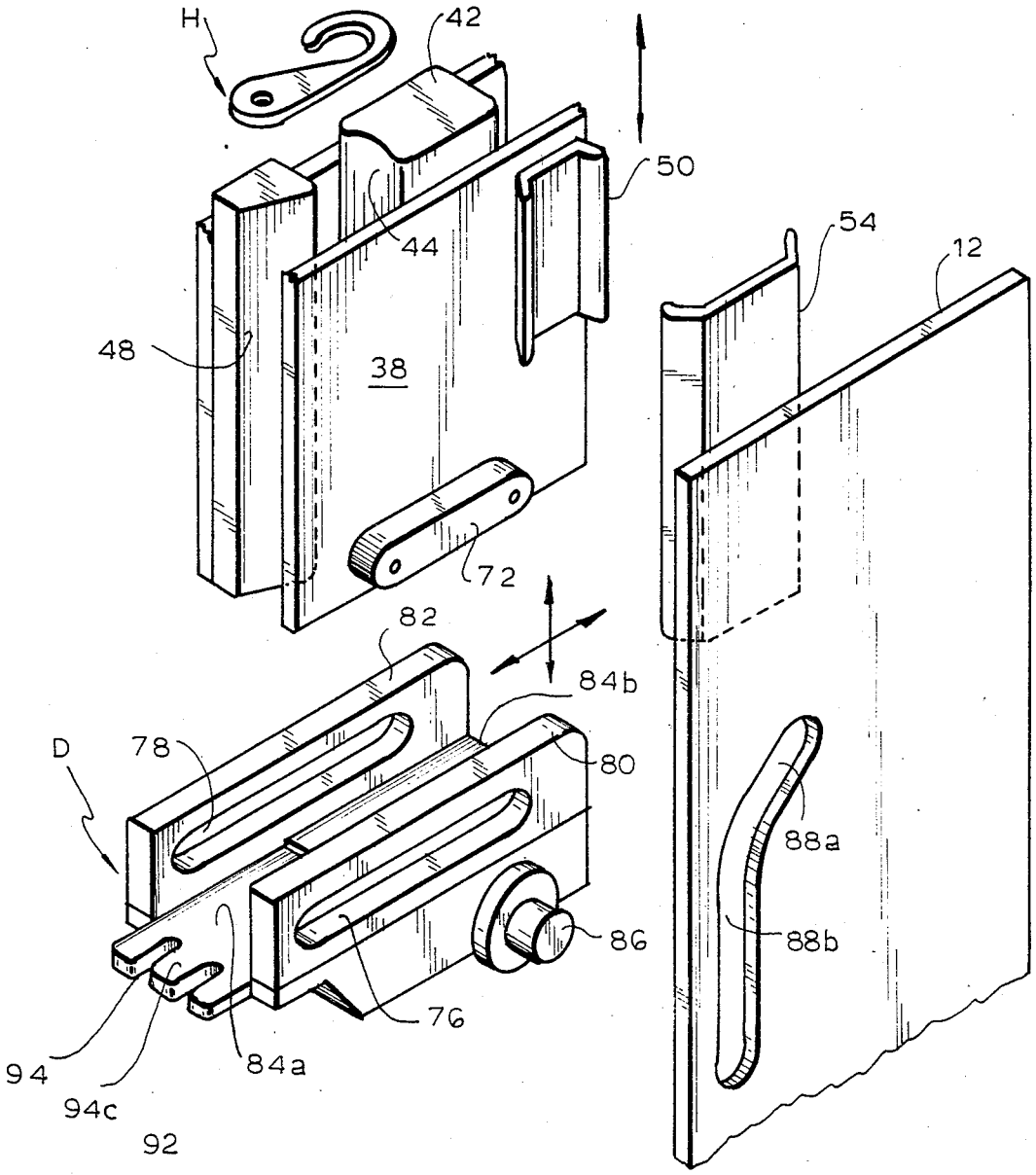
FIG. 5 is an exploded isometric view of the retaining means and the dispensing means of the present invention.
Figure 6:
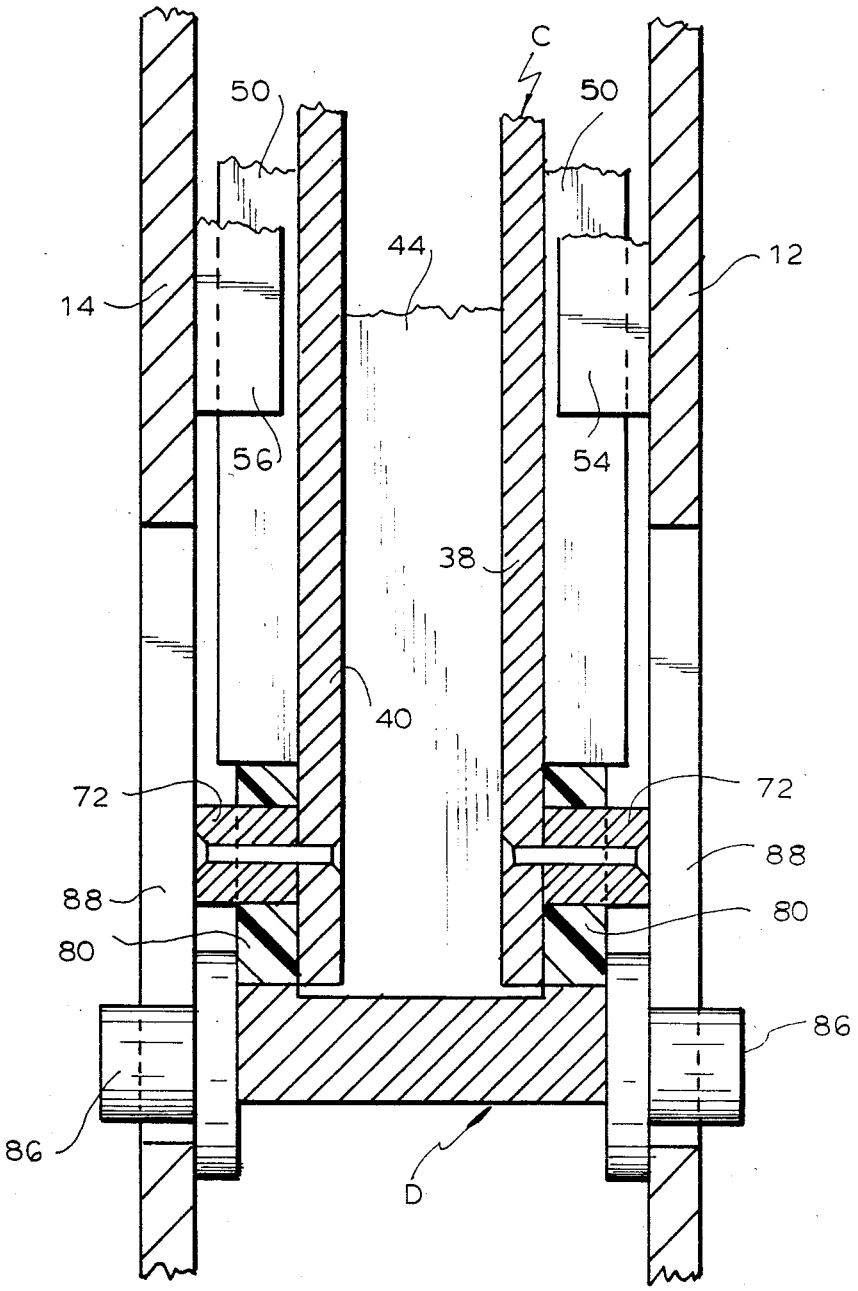
FIG. 6 is a sectional view of the present invention taken along line 6—6 of FIG. 2.

Movably mounted between the upper portions of support members 12 and 14 is a hook retainer, generally designated C. Retainer C is designed to hold a stack of plastic hooks H, as shown in FIG. 5. Retainer C has mounted thereon a hook dispenser, generally designated D. Dispenser D is designed to move vertically with retainer C and move horizontally relative to retainer C in order to align the first hook from the bottom of the stack mounted on retainer C with needle 24 of attacher A.

As best seen in FIG. 5, retainer C includes a pair of spaced parallel, generally rectangular members 38, 40 which form the sides thereof. Members 38 and 40 partially define a cavity into which the stack of hooks H is situated. The rear end of the cavity is defined by a block 42 which is mounted between members 38 and 40 and which has a forward facing surface 44 which is slightly concave in order to accommodate the curved trailing edge of hooks H.

Figure 4:
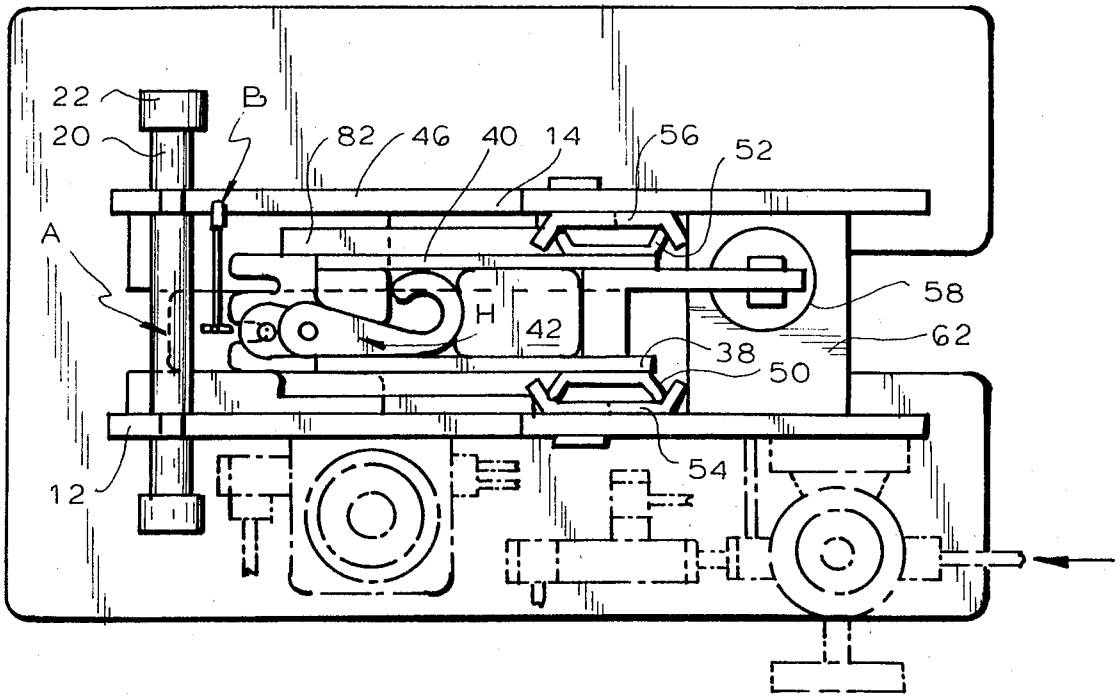
FIG. 4 is a top view of the present invention.

As can best be seen in FIG. 4, hooks H are mounted within retainer C with the non-inclined edge of the hook adjacent one of the members 38 or 40. In order to maintain hooks H in the proper position within retainer C, a member 46 having an inclined surface 48 is situated adjacent the central portion of hooks H. Surface 48 of member 46 abuts the inclined inner edge of the hooks and maintains the non-inclined edge of the hooks against the opposite member 38 or 40.

As shown in FIG. 4, the non-inclined edge of hooks H is situated adjacent member 38 and member 46 is situated adjacent member 40. This permits hooks H to be dispensed from retainer C in a first orientation. However, for some applications, it is necessary to dispense the hooks H in a second orientation. In order to do this, member 48 is removed from between members 38 and 40 and placed adjacent the interior surface of member 38 such that the stack of hooks can be received in the opposite orientation, with the non-inclined edge adjacent member 40.

In the first orientation, the holes in the hooks align with one slot in dispenser D. In the second orientation, the holes align with a different slot in dispenser D. The position of attacher A relative to member 10, 12 is also changed when the hooks are re-oriented such that needle 24 aligns with the appropriate slot in dispenser D.

Extending from the exterior surfaces of members 38 and 40 are brackets 50, 52. Each of the brackets 50, 52 has a pair of outwardly extending inclined edges which are situated to fit between the outstanding inclined edges of a pair of brackets 54, 56, respectively mounted to the interior surfaces of support members 12 and 14 and which extend upwardly therefrom. Brackets 50, 54 and 52, 56 form guides for the vertical movement of retainer C with respect to support members 12 and 14.

A second pneumatic cylinder 58 is fixedly mounted between support members 12 and 14 by means of a bracket 62 to which the top of cylinder 58 is fixedly mounted. A cylinder rod 64 of cylinder 58 is connected to retainer C through a member 66 which extends rearwardly from retainer C.

Piston rod 64 of cylinder 58 is normally in the extended position so as to hold retainer C in its uppermost position, as shown in FIG. 1. When cylinder 58 is actuated, piston rod 64 retracts, moving retainer C to its lowermost position, as seen in FIG. 2. As retainer C reaches its lowermost position, the rear portion thereof will abut an actuator 68 of a pneumatic switch 70 which, when actuated, will cause cylinder 28 to extend piston rod 32 so as to actuate attacher A.

As best seen in FIG. 5, the exterior surfaces of members 38 and 40 which define retainer C are provided with outwardly extending horizontal oval shaped blocks or projections 72, 74, respectively. Projections 72 and 74 are respectively received within similarly shaped slots 76, 78 in the upstanding walls 80, 82 of hook dispenser D. Projections 72, 74 and slots 76. 78 act to mount dispenser D to the bottom of retainer C and, in addition, permit dispenser D to move relative to retainer C in a generally horizontal direction, that is, in a direction substantially perpendicular to the movement of retainer C.

Walls 80, 82 are mounted on a slide or platform 84 which has a step-like configuration including a lower surface 84*a* and an upper surface 84*b*. The forward portion 84*c* of lower surface 84*a* extends forwardly beyond the front edges of walls 80, 82. Below platform 84 is a shaft 86 which extends outwardly beyond the exterior surfaces of walls 80 and 82. The ends of shaft 86 are respectively received within a pair of slots 88, 90 situated in support members 12 and 14, respectively. Slots 88 and 90 each comprise an upper inclined portion 88*a*, 90*a* and a lower vertical portion 88*b*, 90*b*.

When retaining means C is in its uppermost position, as shown in FIG. 1, shaft 86 is situated at the top of slot portions 88*a* and 90*a*. As retainer C is moved downwardly by cylinder 58, shaft 86 rides along the inclined portion 88*a* and 88*b* of the slots, in a direction approximately 45° to the vertical, until the shaft enters the vertical portions 88*b*, 90*b* of the slots. Once in the vertical portions of the slots, shaft 86 will move vertically until it is situated at the lower end of the slots, as shown in FIG. 2.

As will now be readily appreciated, the shape of slots 88 and 90 will cause dispenser D to move horizontally with respect to retainer C, for the first portion of the downward vertical motion of retainer C and, thereafter, will retain dispenser D in its extended position with respect to retainer C for the remainder of the vertical movement of retainer C. Once retainer C reverses direction and moves upwardly, the shape of slots 88 and 90 will cause dispenser D to remain in its extended position with respect to retainer C for the first portion of the upper movement (until shaft 86 enters inclined portions 88*a* and 88*b*) and, thereafter, will cause dispenser D to move rearwardly, towards its retracted position, as retainer C approaches its uppermost position.

This mechanical arrangement automatically causes dispenser D to move between its extended and retracted positions as retainer C moves between its uppermost and lowermost positions. Accordingly, no separate moving means is required for dispenser D as a single pneumatic cylinder 58 is used in the present invention to provide movement of retainer C which, in turn, will automatically cause the extension and retraction of dispenser D.

When dispenser D is in its retracted position, surface 84*a* of platform 84 will align with the lowermost hook in the stack. The step which defines surface 84*b* will lodge immediately behind the curved portion of the trailing edge of the hook. The height of this step is somewhat less than the thickness of the hook such that when dispenser D moves to its extended position with respect to retainer C, the step which defines surface 84*b* will cause the lowermost hook on the stack to move along with dispenser D such that the aperture therein will be in alignment with the needle.

Surface 84*c* of platform 84 has a pair of slots 92, 94 therein which are respectively situated to align with the opening in hooks H in either of its two orientations. Openings 92 and 94 will permit platform 84 to move over needle 24 when retainer C is in its lowermost position such that needle 24 will extend through the opening in the hook which is situated on platform 84.

As best seen in FIGS. 10 and 11, surface 84*a* of platform 84 may be provided with an upwardly spring loaded member 96 which is situated to align with the inner edge of the curved portion of the hook. The surface of member 96 is curved such that it will normally be cammed out of the way when the hook is removed from dispenser D. However, if for some reason the hook has not neen removed from platform 84, member 96 will retain it on the platform, in a fixed position, as the dispenser D retracts. If member 96 were not present, and the hook on surface 84*a* was not removed from platform 84, the apparatus could jam as dispenser D retracts. However, through the use of member 96, even if the hook has not been removed from dispenser D, no jamming can occur as the dispenser retracts.

Figure 7A:
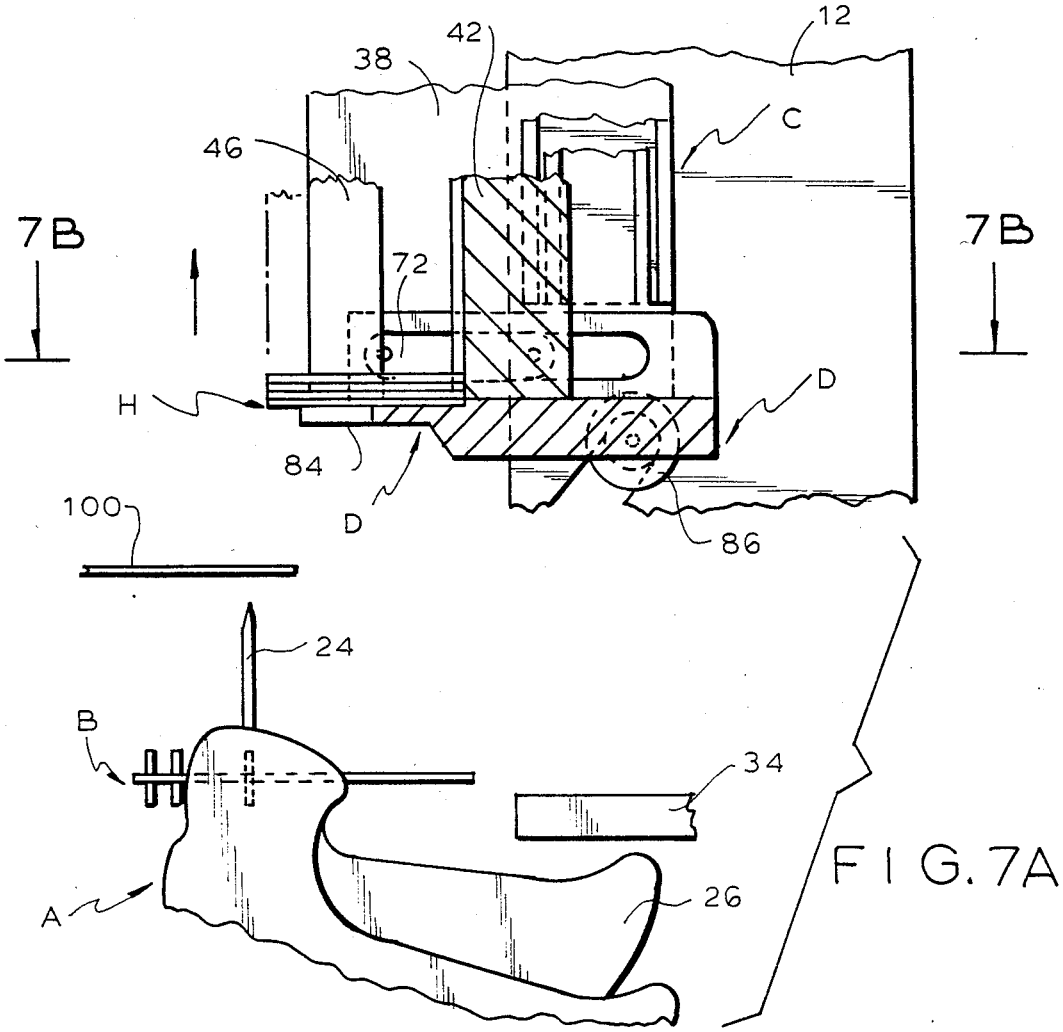
Figure 7B:
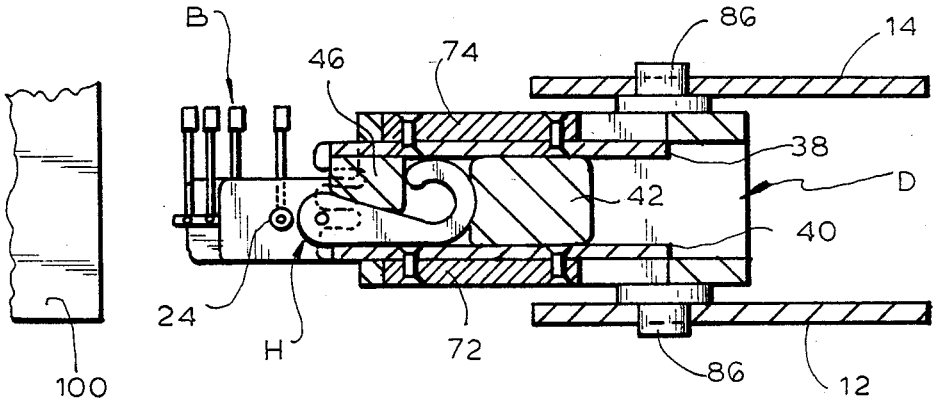
Figure 8A:
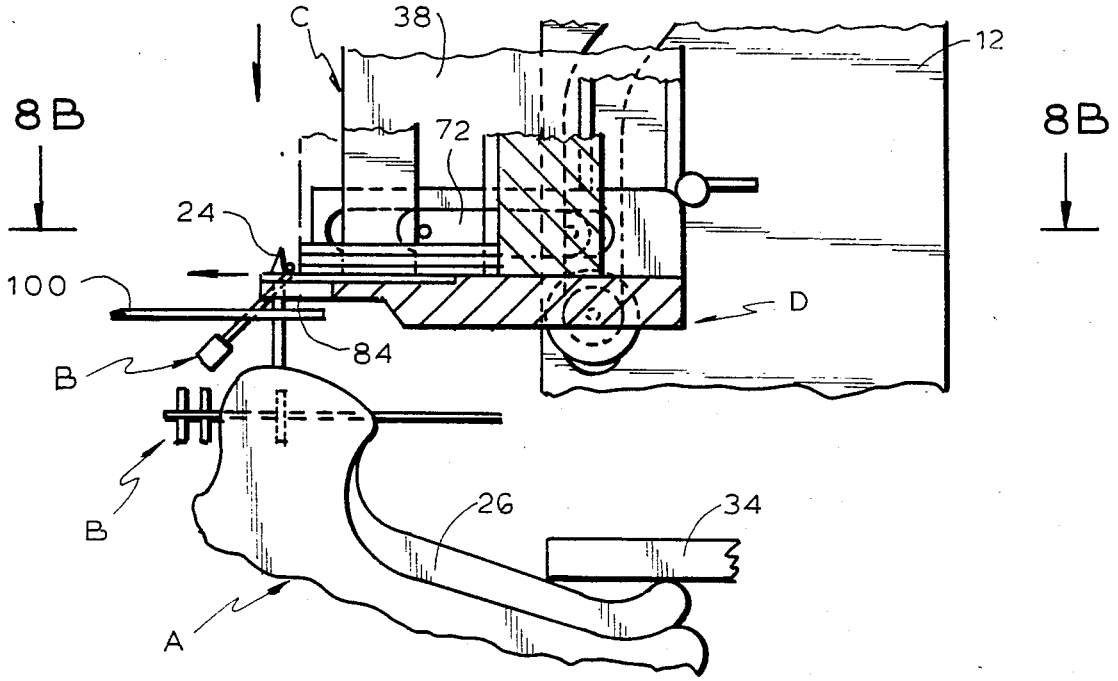
Figure 8B:
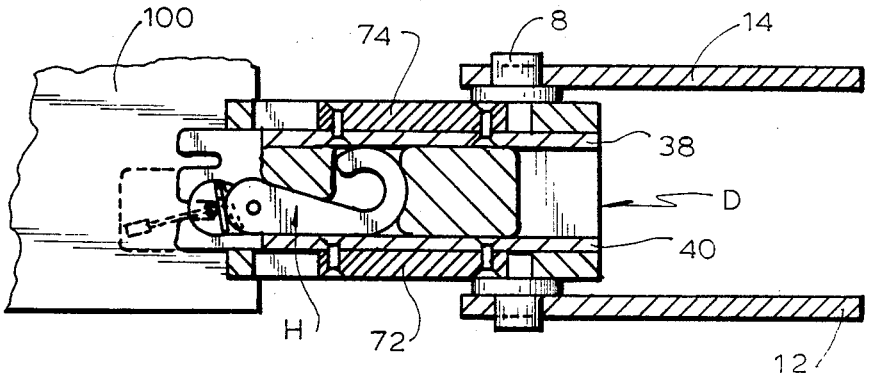

The operation of the present invention may be best understood with reference to FIGS. 7, 8, and 9. FIGS. 7A, 8A, and 9A show sequential side views of the apparatus, whereas FIGS. 7B, 8B, and 9B show sequential top views of the apparatus. As shown in FIGS. 7A and 7B, the sequence begins with retainer C at its uppermost position with respect to attacher A and with dispenser D in its retracted position with respect to retainer C. The article 100 to which the hook H is to be attached is held by the operator above and in alignment with needle 24 of attacher A. The operator then actuates cylinder 58, through means of a foot pedal (not shown) or the like, and piston rod 64 retracts, moving retainer C downwardly towards attacher A.

During the first portion of the downward movement of retainer C, shaft 86 on dispenser D moves through the inclined portion of slots 88 and 90 causing dispenser D to move forward to its extended position with respect to retainer C such that the bottommost hook on the stack has its opening aligned with needle 24. Further downward movement of retainer C will cause article 100 to be received over needle 24 as the bottom surface of platform portion 86*c* moves over the needle such that the needle pierces the article 100 and extends through the slot in platform 84 and the opening in the dispensed hook.

As retaining means C reaches the end of its downward movement, switch actuator 68 is tripped, actuating cylinder 28 such that an attacher B is dispensed from needle 24 of attacher A and the T-bar end thereof is pushed out of needle 24 such that it is situated beyond the upper surface of the dispensed hook. This is illustrated in FIG. 8. Cylinder 28 automatically reverses, releasing trigger 26 in a short time.

The operator then releases the foot pedal which causes cylinder 58 to extend piston rod 64 such that retainer C moves upwardly towards its uppermost position. For the first portion of this upward movement, dispenser D remains in its extended position. However, when shaft 86 moves to the upper inclined portion of slots 88 and 90, dispenser D will move to its retracted position with respect to retainer C such that the next hook in the stack will be situated on surface 84*b* of platform 84. After retainer means C begins to move upwardly and is in a position remote from needle 24, article 100 which now has a hook H attached thereto by means of a fastener B is removed from the apparatus, as shown in FIG. 9.

However, if for some reason an attachment B is not dispensed from attacher A, either because attacher A is jammed or is out of attachments, member 96 protrudes above the surface portion 84*a* when platform 84, as dispenser D retracts, so as to retain the hook on dispenser D in a fixed position until dispenser D is fully retracted (see FIGS. 10 and 11).

Alternatively, a hook realignment means, as illustrated in FIGS. 12–14, may be used to avoid jamming. In one embodiment, the realignment means may comprise a member 110 fixedly mounted to member 12 which includes a forward portion 112 which is situated in alignment with the leading edge of a hook on platform 84. When cam 86 and slot 88 cause platform 84 to retract, the inclined surface of portion 112 will cooperate with the leading edge of the hook on platform 84 to insure that the hook moves with the platform to realign with the stack.

FIGS. 12 and 13 show a modified version in which a member 114 is slideably mounted to member 12. Shaft 86 is extended outwardly such that as it moves upwardly in slot 88, it will enter an internal groove 118 in member 114 and cause member 114 to move rearwardly. The front 116 of member 114 has a downwardly projecting lip positioned to engage the leading edge of a hook on platform 84 such that the hook moves with the platform as it retracts.

It should now be appreciated that the present invention relates to an automatic hook attaching apparatus which is simplified with respect to prior art machines of this type in that only a single pneumatic cylinder is required to dispense the hook and place same over the needle. Further, the apparatus is versatile enough to permit hooks to be dispensed in one of two orientations. In addition, jamming of the apparatus is eliminated by insuring that a hook, if not removed from the dispenser D, will be retained thereon in a fixed position until the dispenser is fully retracted or will be automatically realigned with the stack.

While only a limited number of preferred embodiments of the present invention have been disclosed herein for purposes of illustration, it is obvious that many variations and modifications could be made thereto. It is intended to cover all of these variations and modifications which fall within the scope of the present invention as defined by the following claims.

We claim:

1. Apparatus for attaching a hook or the like to an article, the hook being of the type having an aperture therein, said apparatus comprising a base, means on said base for fixedly mounting a fastener attacher of the type having a hollow needle through which fasteners are dispensed in response to the actuation of the attacher, means for actuating the attacher, means for retaining a stack of hooks, means mounted on said retaining means for dispensing hooks, one at a time, from said retaining means, means for mounting said retaining means and said dispensing means, for movement as a unit, in a first direction, said mounting means comprising means for automatically moving said dispensing means relative to said retaining means, in response to the movement of said retaining means in said first direction, said dispensing means moving in a second direction relative to the needle to align a hook therewith and means for moving said retaining means in said first direction, said retaining means comprising first and second spaced, substantially parallel walls between which the stack is situated and holding means comprising a member adapted to be situated in one of two orientations relative to said walls to hold the stack adjacent one of said first and second walls.

2. Apparatus for attaching a hook or the like to an article, the hook being of the type having an aperture therein, said apparatus comprising a base, means on said base for fixedly mounting a fastener attacher of the type having a hollow needle through which fasteners are dispensed in response to the actuation of the attacher, means for actuating the attacher, means for retaining a stack of hooks, means mounted on said retaining means for dispensing hooks, one at a time, from said retaining means, means for mounting said retaining means and said dispensing means, for movement as a unit, in a first direction, said mounting means comprising means for automatically moving said dispensing means relative to said retaining means, in response to the movement of said retaining means in said first direction, said dispensing means moving in a second direction relative to the needle to align a hook therewith and means for moving said retaining means in said first direction, said retaining means comprising first and second substantially parallel spaced walls and wherein the hooks in said stack each comprise a first edge adapted to be situated substantially parallel to one of said walls and a second edge adapted to be situated in inclination with respect to said one wall and wherein said retaining means further comprises a holding member, said holding member comprising a surface adapted to be situated substantially parallel to the wall opposite said one wall and an inclined surface adapted to be situated adjacent said second edge of the hooks.

3. The apparatus of claim 2, wherein said hooks and said holding member can be reoriented within said retaining means such that said edge adapted to be situated parallel to said one wall is situated parallel to said other wall and said surface adapted to be included with respect to said other wall is inclined with respect to said first wall.

4. Apparatus for attaching a hook or the like to an article, the hook being of the type having an aperture therein, said apparatus comprising a base, means on said base for fixedly mounting a fastener attacher of the type having a hollow needle through which fasteners are dispensed in response to the actuation of the attacher, means for actuating the attacher, means for retaining a stack of hooks, means mounted on said retaining means for dispensing hooks, one at a time, from said retaining means, means for mounting said retaining means and said dispensing means, for movement as a unit, in a first direction, said mounting means comprising means for automatically moving said dispensing means relative to said retaining means, in response to the movement of said retaining means in said first direction, said dispensing means moving in a second direction relative to the needle to align a hook therewith and means for moving said retaining means in said first direction, said dispensing means comprising a platform movable in said second direction to align a hook with the needle and retract, and further comprising means for holding the hook on said platform as said platform retracts, if the hook has not been removed therefrom.

5. The apparatus of claim 4, wherein said means for holding the hook on said platform as the platform retracts comprises a spring-loaded member having a curved upper surface.

6. Apparatus for attaching a hook or the like to an article, the hook being of the type having an aperture therein, said apparatus comprising a base, means on said base for fixedly mounting a fastener attacher of the type having a hollow needle through which fasteners are dispensed in response to the actuation of the attacher, means for actuating the attacher, means for retaining a stack of hooks, means mounted on said retaining means for dispensing hooks, one at a time, from said retaining means, means for mounting said retaining means and said dispensing means, for movement as a unit, in a first direction, said mounting means comprising means for automatically moving said dispensing means relative to said retaining means, in response to the movement of said retaining means in said first direction, said dispensing means moving in a second direction relative to the needle to align a hook therewith and means for moving said retaining means in said first direction, said mounting means comprising a member fixedly mounted to said base and having a cam surface and said dispensing means comprising a cam follower in operative engagement with said cam surface, said cam surface comprising a first portion and a second portion, said first portion extending in a third direction and said second portion extending in said first direction, said third direction being between said first and second directions, and further comprising means for realigning a hook with the stack, said means comprising a member having an inclined surface positioned to cooperate with the edge of the hook to move the hook with said dispensing means as said cam follower moves in said third direction.

7. Apparatus for attaching a hook or the like to an article, the hook being of the type having an aperture therein, said apparatus comprising a base, means on said base for fixedly mounting a fastener attacher of the type having a hollow needle through which fasteners are dispensed in response to the actuation of the attacher, means for actuating the attacher, means for retaining a stack of hooks, means mounted on said retaining means for dispensing hooks, one at a time, from said retaining means, means for mounting said retaining means and said dispensing means, for movement as a unit, in a first direction, said mounting means comprising means for automatically moving said dispensing means relative to said retaining means, in response to the movement of said retaining means in said first direction, said dispensing means moving in a second direction relative to the needle to align a hook therewith and means for moving said retaining means in said first direction, said mounting means comprising a member fixedly mounted to said base and having a cam surface and said dispensing means comprising a cam follower in operative engagement with said cam surface, said cam surface comprising a first portion and a second portion, said first portion extending in a third direction and said second portion extending in said first direction, said third direction being between said first and second directions, and further comprising means for realigning a hook with the stack, said realigning means comprising a member comprising means for engaging the edge of the hook and means for moving said member in said second direction.

8. The apparatus of claim 7, wherein said means for moving said member comprises said cam and a second cam surface on said member.

9. Apparatus for attaching a hook or the like to an article, the hook being of the type having an aperture therein, said apparatus comprising a base with a fixed member, means on said base for fixedly mounting a fastener attacher of the type having a hollow needle through which fasteners are dispensed in response to the actuation of the attacher, means for actuating the attacher, means for retaining a stack of hooks, means movably mounted on said retaining means for dispensing hooks, one at a time, from said retaining means, means for mounting said retaining means and said dispensing means for movement, as a unit, relative to said fixed member, in a first direction, said until mounting means comprising means cooperating with said fixed member for displacing said dispensing means in a second direction relative to said retaining means between a first position wherein a dispensed hook is out of alignment with the needle, and a second position wherein the dispensed hook is in alignment with the needle, in response to the movement of said unit in said first direction, and means for moving said unit in said first direction.

10. The apparatus of claim 9, wherein said retaining means comprises means for holding the stack on said retaining means in one of two different orientations.

11. The apparatus of claim 9, wherein said dispensing means comprises a platform movably mounted on said retaining means adjacent one end of said stack, said platform comprising a surface normally aligned with said stack and abutting means normally engaging the trailing edge of the first hook in said stack.

12. The apparatus of claim 11, wherein said abutting means has a height which is less than the thickness of a hook.

13. The apparatus of claim 11, wherein said surface has a portion aligned with the leading portion of said first hook and wherein said surface portion has an opening therein aligned with the aperture in said first hook.

14. The apparatus of claim 13, wherein the hooks can be retained in said retaining means in one of two orientations and said surface has first and second openings therein, each of said openings aligning with the aperture in said first hook when said first hook is in a different one of the orientations.

15. The apparatus of claim 9, wherein said fixed member comprises a cam surface and wherein said displacing means comprises a cam follower in operative engagement with said cam surface.

16. The apparatus of claim 15, wherein said cam surface comprises a first portion and a second portion, said first portion extending in a third direction and said second portion extending in said first direction, said third direction being between said first and second directions.

17. The apparatus of claim 16, further comprising means for realigning a hook with the stack, said means comprising a member comprising means for engaging the edge of the hook and means for moving said member in said second direction.

18. The apparatus of claim 15, said member comprising means for guiding the movement of said retaining means in said first direction.

19. The apparatus of claim 18, further comprising means for guiding the movement of said dispensing means relative to said retaining means in said second direction.

* * * * *